United States Patent [19]

Rogers

[11] Patent Number: 4,513,951

[45] Date of Patent: Apr. 30, 1985

[54] STAPLE REMOVER

[76] Inventor: E. Mark Rogers, 3052 Kingstowne Club Dr., Smyrna, Ga. 30080

[21] Appl. No.: 589,178

[22] Filed: Mar. 12, 1984

[51] Int. Cl.[3] ..... B25C 11/00

[52] U.S. Cl. ..... 254/28

[58] Field of Search ..... 254/28; 227/63

[56] References Cited

U.S. PATENT DOCUMENTS

| | | | |
|---|---|---|---|
| 2,079,672 | 5/1937 | Allen et al. | 254/28 |
| 3,625,482 | 12/1971 | Viel | 254/28 |
| 3,761,057 | 9/1973 | Nembhard et al. | 254/28 |

FOREIGN PATENT DOCUMENTS

| | | | |
|---|---|---|---|
| 862468 | 3/1961 | United Kingdom | 254/28 |

*Primary Examiner*—Frederick R. Schmidt
*Assistant Examiner*—Judy J. Hartman
*Attorney, Agent, or Firm*—Newton, Hopkins & Ormsby

[57] ABSTRACT

A staple remover avoids scattering of removed staples by delivering them in a controlled manner onto a storage rail where they are clearly viewable to indicate when the storage rail requires emptying. A handle pivoted to the storage rail carries on its face opposing the storage rail a textile element which prevents removed staples from traveling toward the forward end of the storage rail and stabilizes the removed staples until they are separated from the storage rail.

10 Claims, 4 Drawing Figures

STAPLE REMOVER

BACKGROUND OF THE INVENTION

Scattering of removed staples in the vicinity of office machines, particularly photocopiers, frequently results in extensive costly machine damage. Ordinary staple removers do not include a means to prevent staples scattering. Consequently, there is a need in the art for a staple remover which has the capability of dealing with the above problem.

The problem is recognized in U.S. Pat. No. 3,625,482 and a staple remover is disclosed in this patent which separates staples from stapled work and delivers them rearwardly into a storage chamber within the handle of the device to prevent scattering.

The patented device possesses a drawback in that it depends partly on gravity and requires a conscious tilting of the handle of the staple remover by the user to assure that the removed staples enter the storage chamber and do not gravitate forwardly and separate from the device. The patented device also lacks a positive means for preventing retrograde movement of removed staples toward the leading end of the staple removing bar or blade. Furthermore, the removed staples are not viewable while in the storage chamber and a user of the device cannot determine visually when the storage chamber requires emptying.

With the above in mind, the present invention has for its objective to provide an improved and more efficient staple remover which eliminates dangerous scattering of removed staples while providing a clear view of the staples as they are accumulated on a storage rail, so that a user of the device can determine at a glance when the storage rail requires emptying.

A further object and feature of the invention is to provide in a staple remover of the mentioned class a means to positively engage removed staples on the storage rail to stabilize the same while they are being accumulated and to prevent them from gravitating in an uncontrolled manner back toward the leading end of the staple removing bar.

Another object is to provide a staple remover in which the staples which have been removed are stored and in which the stored staples, even though rotated will be precluded from readily moving laterally out of their stored area.

Still another object of the invention is to provide a comfortable handle on the staple remover which is pivoted thereto to facilitate emptying the removed staple storage rail and which carries the element which controls and stabilizes staples on the storage rail.

Other features and advantages of the invention will become apparent to those skilled in the art during the course of the following detailed description.

DETAILED DESCRIPTION

Figure 4:
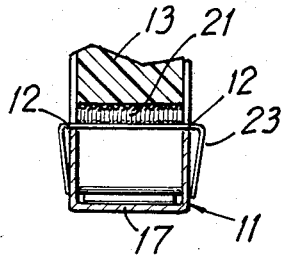
FIG. 4 is an enlarged transverse vertical section taken on line 4—4 of FIG. 3.

Referring to the drawings in detail, wherein like numerals designate like parts, a staple remover according to the invention comprises a leading staple engaging and removing blade 10 integrally attached to the forward end of an elongated gradually tapering removed staple storage rail 11. The storage rail 11 is preferably a channel rail, as clearly shown in FIG. 4, the top edges 15 of which are inclined upwardly and rearwardly on a gradual straight slope from the rear of the blade 10. The bottom face of the storage rail 11 occupies a common plane with the blade 10 and the top edges 12 diverge from such plane at an acute angle of 10°–15°, which angle is not critical and may be varied.

The staple remover further comprises a manipulating handle 13 which is designed to conform comfortably to the hand. The handle 13 near its rear end is pivotally connected by a transverse pivot pin 14 between a pair of rear end spaced upstanding ears 15 on the storage rail 11. The handle at its rear end and bottom includes an integral rectangular shoulder 16 engaging between the ears 15 and adapted to contact the bottom wall 17 of the rail 11 to limit the movement of the handle toward the inclined top of the rail 11, thereby forming and maintaining a narrow gap therebetween when the handle is in the normal down position shown in full lines in the drawings.

The handle 13 is normally biased in the down position by the action of a curled leaf spring 18 attached at 19 to the bottom wall 17 of storage rail 11 near the rear end thereof. The curled spring enters a recess 20 of the handle shoulder 16 to urge the handle 13 to its down and locked position above the rail 11. The spring yields under a camming action induced by the handle when the handle is swung upwardly to the separated steeply inclined divergent position relative to the rail 11 shown in phantom lines in FIG. 2.

In accordance with an important feature of the invention, the bottom flat fact of the handle 13 which is in spaced parallel opposed relationship to the inclined upper face of storage rail 11 has secured thereto a somewhat compressible pad or strip 21, preferably formed of a textile material, such as a woven or pile fabric. Woven nylon is a suitable material for the pad 21, which could also be formed from loop pile material of the kind forming one component of a separable fastener having a second component formed from a multiplicity of minute hook elements. Other materials, such as felt, could also be used for the pad or strip 21 which preferably extends for substantially the full length of the handle, forwardly of its shoulder portion 16 and for a major portion of the length of the rail 11. The strip 21 can be secured to the handle 13 by adhesive or other suitable means.

A retaining element or clip 22 for removed staples 23 is attached as at 24 to a beveled surface 25 of the handle 13 near its forward end. The handle is further recessed at 26 immediately rearwardly of the attachment point of the retaining element 22 so that the latter may bend and yield upwardly as shown in FIG. 3 to permit the free passage of each removed staple from the blade 10 onto the storage rail 11. The retaining element 22 is in the form of a thin normally flat spring plate or leaf, as shown. The compressible textile strip 21 extends over the recessed surface 26 and can yield when compressed by the element 22, as shown in FIG. 3, to allow the passage of each removed staple onto the rail 11 beyond the retaining element 22. After such passage, the retaining element 22 returns automatically by spring action to its normal flat state, FIGS. 1 and 2, where it engages between the two side webs of storage rail 11 and terminates near and above the bottom wall of the rail.

OPERATION

Figure 1:
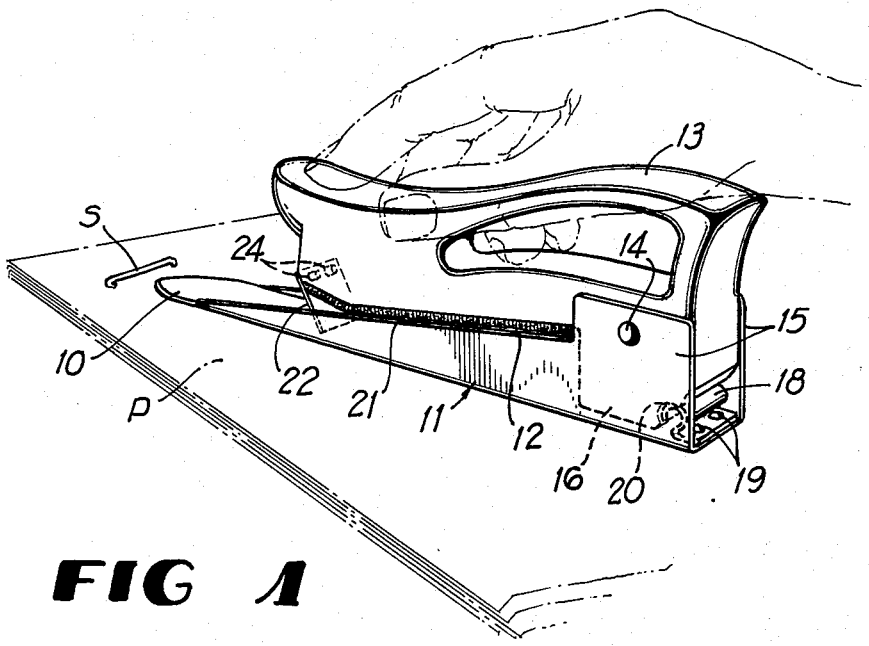
FIG. 1 is a perspective view of a staple remover according to the present invention.
Figure 2:
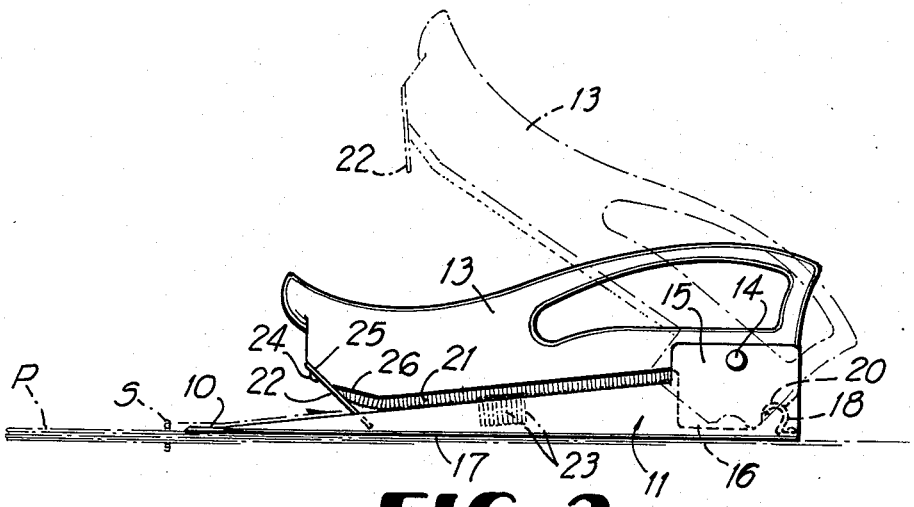
FIG. 2 is a side elevation thereof with the handle shown pivoted away from the staple storage rail in phantom lines.
Figure 3:
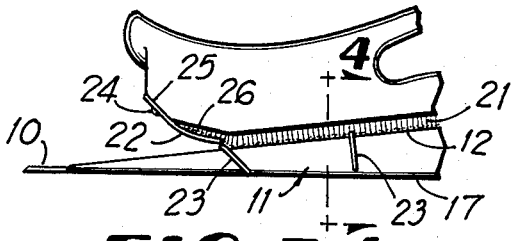
FIG. 3 is a fragmentary side elevation showing a retaining clip on the handle of the device in yielding position to allow a removed staple to pass onto the storage rail.

As shown in FIGS. 1 and 2, a user of the staple remover grips the handle 13 and guides the staple removing blade 10 under a staple S requiring removal from papers P. Forward movement of the blade relative to the staple S causes the leading end of the inclined storage rail 11 to pass under the staple S and gradually dislodge it from the papers by a strong lifting action until the removed staple is astride the storage rail 11. Continued forward movement of the staple remover causes each staple being removed to trip under the yielding retainer element 22 prior to the time that it is fully dislodged from the papers P, FIG. 3. Further forward movement of the staple remover after the staple passes the element 22 results in the complete removal of the staple from the papers and the gradual lifting of the removed staple above the top surface of the papers. In the meantime, the retainer element 22 has returned to its normal flat state thereby preventing the removed staple from passing forwardly beyond the retaining element as long as the handle 13 is in the normal down position.

As subsequent staples are similarly removed from paper or any other stapled media, such removed staples engage and pass beneath the spring retaining element 22 in the described manner and are fed up onto the inclined storage rail 11, pushing before them all previously removed staples 23, until eventually the rail 11 is filled with removed staples along its length adjacent to the compressible strip 21.

While the handle 13 is locked in parallel relationship to the inclined upper face 12 of storage rail 11, the action of the strip 21, due to its compressibility, allows removed staples to be forced in succession under the retaining element 22 and upwardly along the rail 11 toward the rear end of the rail, in response to forward movement of the staple remover under control of a user. The strip 21 also prevents any return movement of the staples 23 toward the leading end of the device defined by the blade 10. In other words, the strip 21 overcomes the influence of gravity, and there is never any need to tilt the device to urge the removed staples toward the rear end of the rail 11. Simultaneously, the strip 21 at all times exerts enough pressure on the staples 23 stored on the rail 11 to prevent their dislodgement from the rail, their binding due to misalignment on the rail, and generally stabilizes the staples as they gradually accumulate on the rail.

It will also be seen that the strip 21 prevents lateral movement of the stored staples, even though a particular stored staple may rotate sufficiently that the legs of the staple are parallel to the surface of top edge 12. The pad or strip 21, which can be formed of one element of a pair of VELCRO elements, resists such lateral movement.

The user can visually observe when the rail 11 is filled with staples and required emptying. The staples are never concealed in an enclosure. When emptying is required, the handle 13 with retainer element 22 is merely swung upwardly and away from the rail 11 to the approximate position shown in phantom lines in FIG. 2. The force of spring 18 is overcome by cam action to permit this handle movement.

With the handle and compressible strip 21 removed from the stored staples 23, they can easily be slid off of the forward end of the rail and blade 10 into a trash receptacle. The staple remover thus completely overcomes the dangerous tendency for removed staples to be scattered in the vicinity of office machines or the like.

In comparison to the known prior art, the invention is more convenient to operate, more efficient and fully competitive in terms of manufacturing costs and practicality. Its advantages should now be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A staple remover and storage device to prevent scattering of staples comprising an elongated removed staple storage rail having an inclined upper face and tapering toward its leading end, said leading end terminating in a staple removing blade fixed on said storage rail and being in a common plane with a bottom surface of the storage rail, a cooperative handle having its rear end portion pivotally secured to a rear portion of said storage rail on a pivot axis extending transversely of the handle and storage rail, yielding means biasing said handle toward closely spaced parallel substantially coextensive relationship with the inclined upper face of the storage rail and allowing the handle to be swung away from the storage rail to facilitate emptying the storage rail of removed staples which have accumulated thereon, a yielding retainer element on a forward end portion of the handle disposed in a path of travel of removed staples entering onto the storage rail and preventing return movement of such staples beyond said retainer element toward the forward end of said rail, and a compressible strip of uniform thickness on a face of said handle which is normally opposed to said inclined upper face of the storage rail and exerting yielding stabilizing pressure on removed staples as they accumulate on and along the storage rail, swinging of said handle on said pivot axis away from the storage rail after the storage rail is filled with removed staples allowing such staples to be easily emptied from the storage rail.

2. A staple remover and storage device as defined in claim 1, and said strip being formed of textile material.

3. A staple remover and storage device as defined in claim 2, and said textile material comprising woven nylon.

4. A staple remover and storage device as defined in claim 1, and said storage rail comprising a channel member having its top open, and said yielding retainer element comprising a normally flat inclined spring leaf having its lower end portion projecting somewhat into the open top of said storage rail.

5. A staple remover and storage device as defined in claim 1, and a shoulder element on a bottom rear portion of said handle adapted to engage a bottom wall portion of the storage rail to positively limit downward movement of the pivoted handle toward the inclined upper face of the storage rail to maintain a gap between a bottom face of the handle and said inclined upper face.

6. A staple remover and storage device comprising an elongated wedge-like support and storage rail for removed staples having a leading end thin blade-like terminal, a cooperative handle pivotally secured to a rear portion of said storage rail, means for biasing said handle toward said storage rail and generally coextensive lengthwise with the storage rail and being normally into parallel relationship with a top face of said storage rail said rail being swingable away from said top face to a divergent position to facilitate removing staples which have accumulated on the storage rail, and a removed staple control and stabilizing element on a bottom face of said handle which normally opposes the top face of said storage rail and being somewhat compressible and having a substantially constant thickness along the length of the handle and being adapted to yieldingly engage top portions of staples accumulated on and traveling along said storage rail and retaining means for arresting movement of said staples along said rail and outwardly of said handle.

7. A staple remover and storage device as defined in claim 6, and a spring retainer element carried by a forward portion of said handle and being in the path of travel of removed staples entering onto the storage rail.

8. A staple remover and storage device as defined in claim 6, and said storage rail having a straight gradually inclined top face and a flat bottom face, and said blade-like terminal being in a common plane with said bottom face.

9. A staple remover and storage device as defined in claim 6, and spring means connected between a rear portions of the storage rail and the handle to bias the handle to said parallel relationship with the top face of the storage rail and yielding to allow swinging of the handle away from said top face to said divergent position.

10. A staple remover and storage device as defined in claim 9, and the spring means comprising a curled leaf spring on the rear portion of the storage rail and being engaged with detent means on a rear portion of said handle having camming engagement with said spring.

* * * * *